US005645211A

United States Patent [19]

Shimada

[11] Patent Number: 5,645,211

[45] Date of Patent: Jul. 8, 1997

[54] EASILY REMOVABLE PACKAGING FILM

[75] Inventor: Toshiyuki Shimada, Mito, Japan

[73] Assignee: Victor Company of Japan, Ltd., Yokohama, Japan

[21] Appl. No.: 626,624

[22] Filed: Mar. 28, 1996

[30] Foreign Application Priority Data

Mar. 30, 1995 [JP] Japan ..... 7-100535

[51] Int. Cl.[6] ..... B65D 65/32

[52] U.S. Cl. ..... 229/87.05; 383/200

[58] Field of Search ..... 229/87.05, 925, 229/926; 383/107, 210, 211, 200, 201

[56] References Cited

U.S. PATENT DOCUMENTS

| | | | |
|---|---|---|---|
| 3,684,976 | 8/1972 | Harrison . | |
| 5,011,014 | 4/1991 | Borck et al. | 229/87.05 X |
| 5,356,068 | 10/1994 | Moreno | 229/87.05 |
| 5,487,503 | 1/1996 | Sato et al. | 229/87.05 |
| 5,560,538 | 10/1996 | Sato et al. | 229/87.05 |

FOREIGN PATENT DOCUMENTS

| | | | |
|---|---|---|---|
| 3-29766 | 2/1991 | Japan . | |
| 03029766 | 2/1991 | Japan . | |
| 5-147672 | 6/1993 | Japan . | |
| 6-183481 | 7/1994 | Japan . | |
| 6-80667 | 11/1994 | Japan . | |
| 6-78273 | 11/1994 | Japan . | |
| 2 239 854 | 7/1991 | United Kingdom . | |
| 2262078 | 6/1993 | United Kingdom | 229/87.05 |
| 9106488 | 5/1991 | WIPO | 229/87.05 |

*Primary Examiner*—Jes F. Pascua
*Attorney, Agent, or Firm*—Michael N. Meller

[57] ABSTRACT

A packaging film for wrapping a cubic article by bonding an overlapped portion by heat and by folding and sealing open ends of the packaging film, a first non-bonded portion is provided as a first opener on the overlapped portion by partially leaving the overlapped portion not bonded, the first non-bonded portion has a width which is not larger than that of the overlapped portion, the first non-bonded portion is an upper layer of the overlapped portion, and a second non-bonded portion is provided by partially leaving the overlapped portion not bonded, the second non-bonded portion is connected continuously to the first non-bonded portion and has a narrower width than that of the first non-bonded portion, and a second opener is provided on a overlapped portion, the second opener is a lower layer of the overlapped portion and is exposed when the first opener is lifted.

10 Claims, 10 Drawing Sheets

EASILY REMOVABLE PACKAGING FILM

BACKGROUND OF THE INVENTION

1. Field of the Invention

The present invention relates to a packaging film to allow an article to be wrapped in a packaging film capable of sealing by heating both ends thereof, and, in particular, relates to a packaging film to allow itself to be removed easily from the packaged article.

2. Description of the Related Art

Generally, various goods are sold being wrapped in a packaging film such as cellophane.

FIGS. 1(A) and 1(B) are perspective view for explaining an ordinary packaging structure using a packaging film in a prior art.

Referring to FIGS. 1(A) and 1(B), a description is given of an ordinary packaging film structure in the prior art, taking an example in which an article 1 to be packaged, a tape cassette accommodated in a protection case, is wrapped up in a packaging film 2 made of, for instance, cellophane, polypropylene or polyethylene telephtalate.

At first, as shown in FIG. 1(A), after a tear tape 3 has been adhered on an inside of the packaging film 2 along a wrapping direction or a lateral direction of the packaging film 2, the packaging film 2 wraps the article 1 in a cylindrical state. An overlapped portion of both ends of the packaging film 2 is connected together by heating. A pair of nicks (or one notch) 4 are preliminary provided nearby one side of the tear tape 3 at a distal end of the packaging film 2 located on an upper side of the overlapped portion 5 to allow the tear tape 3 to be removed readily.

Next, as shown in FIGS. 1(A) and 1(B), free edges 6A and 6B arranged in a longitudinal direction of the packaging film 2, are folded inside together and are connected by welding. Thus, the article 1 is packaged by the packaging film 2.

Upon removing the packaging film 2 from the article 1 packaged, the tear tape nearby the nicks 4 unpacks the article 1 by separating the packaging film 2 as pulled up along a circumference of the article 1. Thus, the article 1 is taken out therefrom.

In the prior art, there are also proposed other film packaging structures requiring no tear tape.

A description is given an example of them in reference to FIGS. 2(A) and 2(B).

FIGS. 2(A) and 2(B) are perspective views for explaining another packaging structure using a packaging film having no tear tape in the prior art.

As shown in FIGS. 2(A) and 2(B), a non-bonded portion 7 is provided to the overlapped portion 5 of the packaging film 2, and a nick 4 is provided nearby the non-bonded portion 7. The overlapping portion 5 except for the non-bonded portion 7 and the free edges 6A and 6B in the longitudinal direction are bonded by heating in the same manner as mentioned in the foregoing.

The packaging film 2 is removed by tearing from the non-bonded portion 7 in cooperation with the nick 4. Then, the article 1 is taken out therefrom.

In the packaging structure shown in FIGS. 1(A) and 1(B), it requires an exclusive equipment for providing the tear tape 3 on the inside face of the packaging film 2. This inevitably invites an increase of the production facility cost.

Further, when employing a heat-shrinking plastic film as the packaging film 2, wrinkles may occur in the portion on which the tear tape is adhered, resulting from the difference of heat shrinkage between the packaging film 2 and the tear tape 3. This causes a degradation of appearance of the article 1 packaged.

Furthermore, when the tear tape 3 is pulled to tear the packaging film 2, only the tear tape may be removed from the packaging film 2 leaving the packaging film 2 as is. This results in being difficult to remove the packaging film 2 from the article 1.

FIGS. 3(A) and 3(B) are perspective views for explaining problems occurring in the packaging film structure in the prior art.

As shown in FIG. 3(A), when the packaging film 2 is separated into two parts, i.e., one portion having a smaller area 2A and another portion having a larger area 2B, by removing the tear tape 8, it is likely that the portion 2A having the smaller area can be readily removed therefrom but the other portion 2B having the larger area remains thereon. This causes a problem that the other portion 2B remaining on the article 1 is difficult to be removed therefrom.

As disclosed in Japanese Patent Laid Open Publication, H3-29766/1991, there is also proposed a packaging film structure requiring no tear tape, wherein a packaging film has an orientation in a tearing direction of the packaging film to allow the packaging film to be torn. In this case, the packaging film is also separated into two portions, i.e., one portion having a smaller area and another portion having a larger area. This causes the same problem that the other portion having a larger area remains thereon and is difficult to be removed therefrom, as mentioned in the foregoing.

In the packaging film structure having no tear tape 3 shown in FIGS. 2(A) and 2(B), there is a problem that a portion nearby the nick 4 curls upward in the heat sealing process or heat shrinking process as shown in FIG. 3(B). This causes a degradation of appearance of the article 1.

SUMMARY OF THE INVENTION

In consideration of the above-described disadvantages in the conventional method of packaging by a film, an object of the present invention is to provide a packaging film which has no tear tape.

It is another object of the present invention to provide a packaging film which is easy and quickly to be removed.

It is further object of the present invention to provide a packaging film which has a good appearance.

Other objects and further features of the present invention will be apparent from the following detailed description with respect to preferred embodiments of the invention when read in conjunction with the accompanying drawings.

DETAILED DESCRIPTION OF THE PREFERRED EMBODIMENTS

Figure 1A:
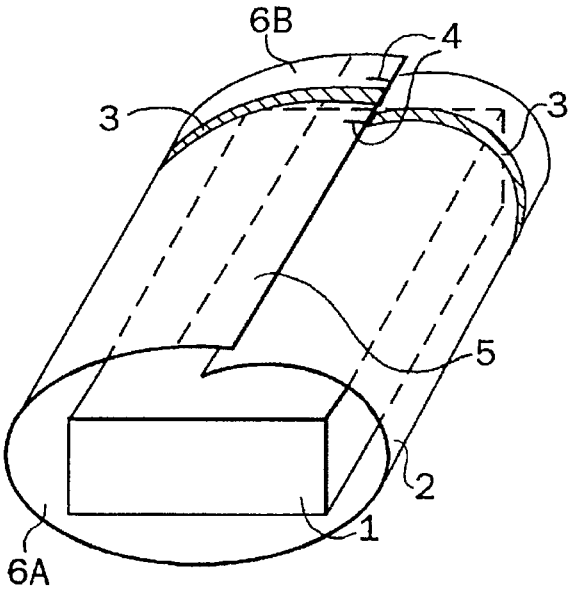
Fig. 1(A) PRIOR ART
FIGS. 1(A) and 1(B) show perspective views of film packaging of prior art.
Figure 1B:
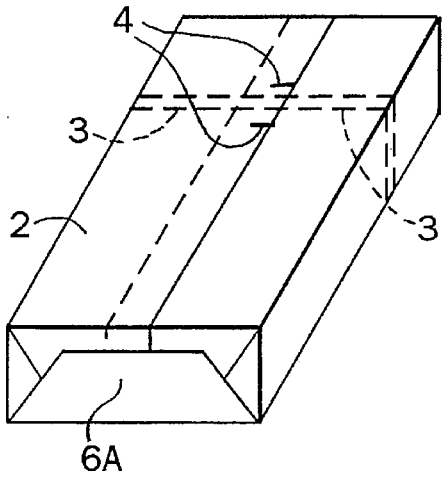
Fig. 1(B) PRIOR ART
Figure 2A:
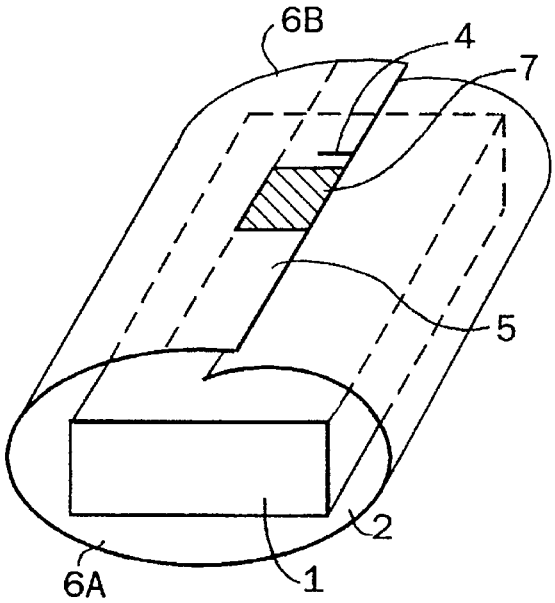
Fig. 2(A) PRIOR ART
FIGS. 2(A) and 2(B) show perspective views of another film packaging of prior art.
Figure 2B:
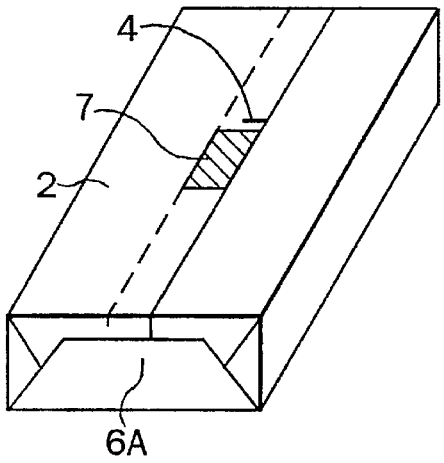
Fig. 2(B) PRIOR ART
Figure 3A:
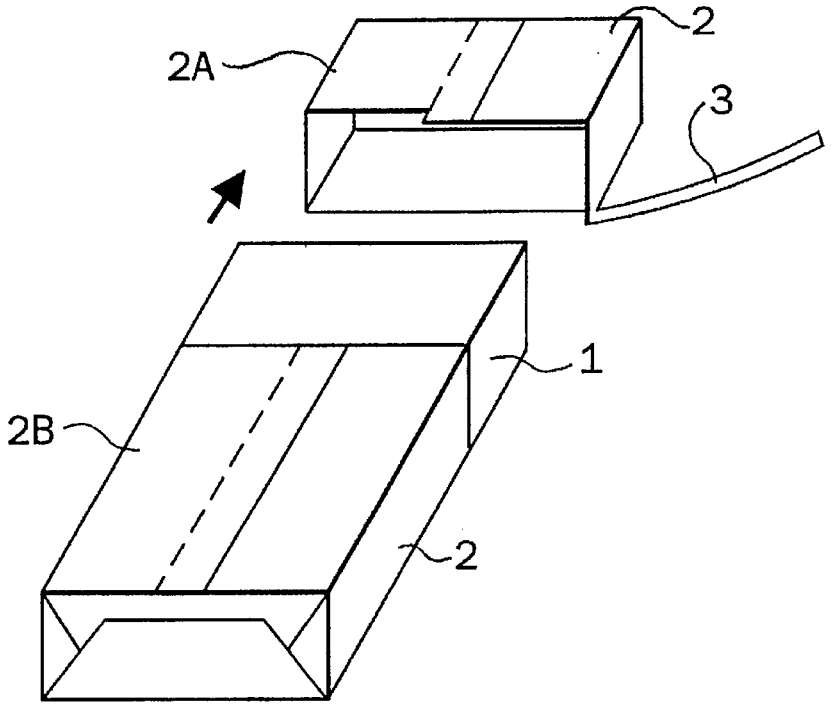
Fig. 3(A) PRIOR ART
FIGS. 3(A) and 3(B) show perspective views of further film packaging of prior art.
Figure 3B:
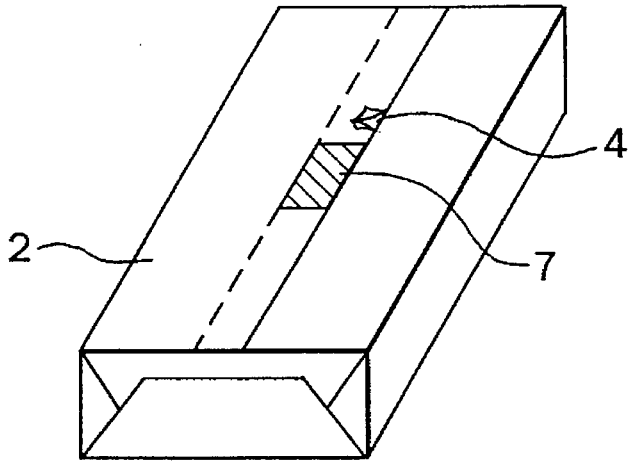
Fig. 3(B) PRIOR ART

A packaging film according to the present invention will be described in detail with reference to the accompanying drawings, in which same reference numerals and symbols are used to denote like or equivalent elements used in the aforementioned prior arts, and detailed explanation of such elements are omitted for simplicity.

[1st Embodiment]

The first embodiment will be explained in reference to FIGS. 4(A) through 6(C).

Figure 5:
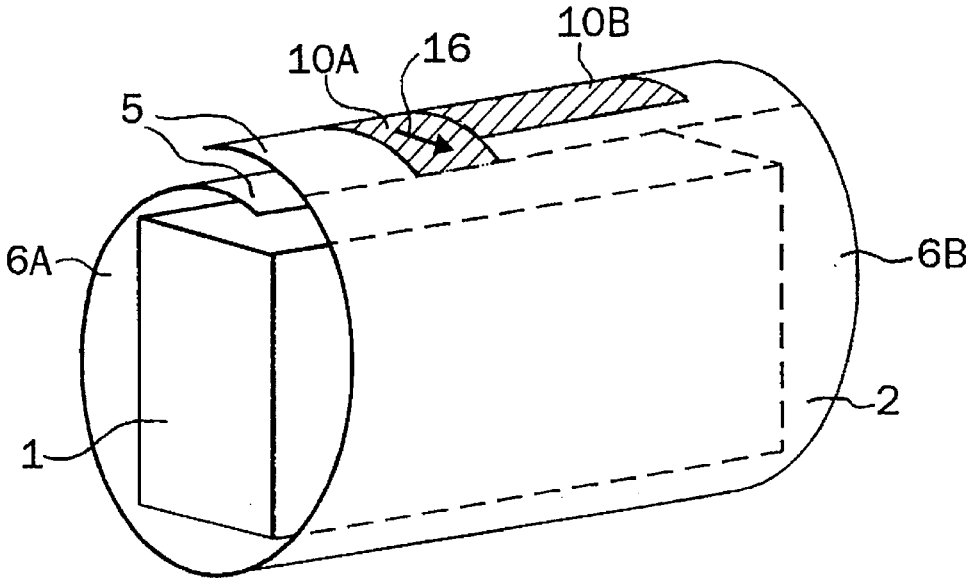
FIG. 5 shows another perspective view of the first embodiment.

In FIG. 5, a numeral 1 denotes an article having a shape of a cube such as a tape cassette accommodated in a protection case, which is wrapped by a packaging film 2 shrunk by heating such as cellophane, polypropylene, or polyethylen telephtalete.

As shown in FIG. 5, the packaging film 2 of which length is longer than a circumference of the article 1 wraps the article 1 in a cylindrical state. An overlapped portion 5 of both ends of the packaging film 2 is bonded together along the center portion of the side face of the article 1.

Figure 4A:
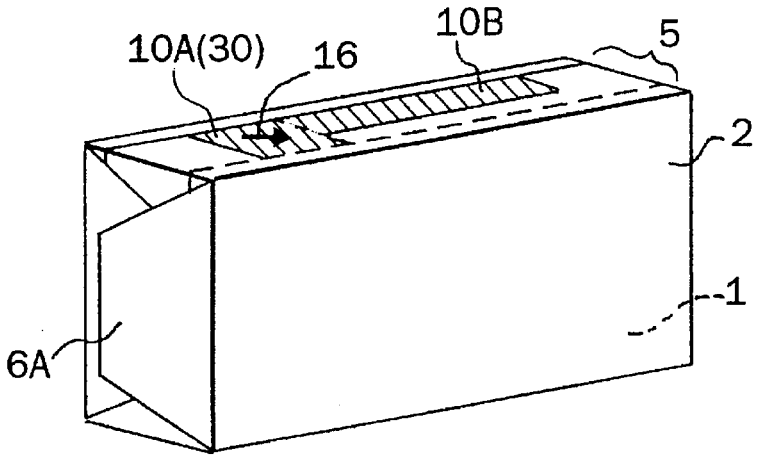
FIGS. 4(A) through 4(C) show perspective views of a first embodiment.

As shown in FIG. 4(A), the overlapped portion 5 is bonded partly, then, a first non-bonded portion 10A is formed thereby, such as shown by FIG. 4(A) the first non-bonded portion 10A is spread to the end of the overlapped portion 5. A second non-bonded portion 10B is continuously formed from the first non-bonded portion 10A, along the edge of the article 1. The width of the second non-bonded portion 10B is smaller than that of the overlapped portion 5, and is larger than a quarter of that of the overlapped portion 5. Therefore the adjacent portions of the first and the second non-bonded portions are bonded, so that the first and the second non-bonded portions do not curl up.

Because of the provision of the second non-bonded area 10B as an opener 30, it is easy to insert a finger for tearing the packaging film 2 to the first non-bonded portion 10A. The first and second non-bonded portions 10A and 10B are prevented upon heat sealing from curling up as the adjacent area thereof is bonded together.

The first non-bonded portion 10A is positioned at the left or right side of the side face of the article 1 and at non-center portion of the side face, and the second non-bonded portion 10B is continuously formed on another side thereof, as shown in FIGS. 4(A) through 5. The area of the second non-bonded portion 10B is larger than that of the first non-bonded portion 10A.

Figure 6A:
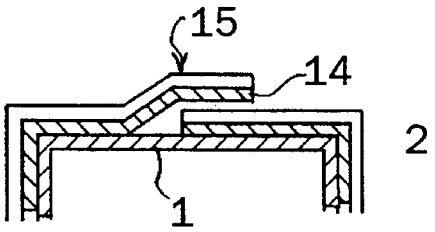
FIGS. 6(A) through 6(C) show sectional, detailed, and partial views of the first embodiment.
Figure 6B:
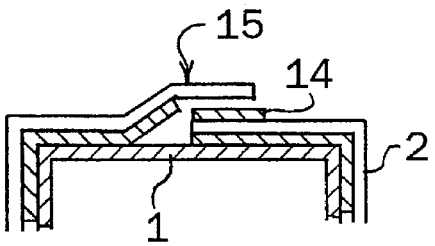
Figure 6C:
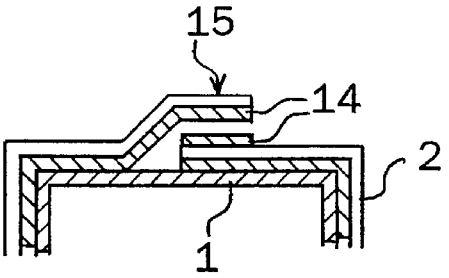

As shown in FIGS. 6(A) through 6(C) the first and second non-bonded portions 10A and 10B can be formed by coating ink 14 on one or both sides of the packaging film in the bonding area 15. Areas which are coated with ink 14 are same as that of the first and second non-bonded portions 10A and 10B respectively, and prevent the packaging film 2 from bonding together. Referring to FIG. 6(B), a printing process on both sides of the packaging film 2 is required with some extra cost, but small.

Another method for providing the first and second non-bonded portions 10A and 10B utilizes a heat bonding apparatus which has a heating iron having, for example, a notch or a thermal insulation material, a shape of which corresponds to that of the first and second non-bonded portions 10A and 10B. Referring to FIG. 6(B), a small modification of the heat bonding apparatus can implement this partial ink coating, and a cost for this modification is small.

A description is given of an example having two openers in reference to FIGS. 4(A), 4(B), 4(C), 5, 7(A) and 7(B).

The opener 30 is formed on an upper end of the overlapped portion 5 of the packaging film 2 as a first opener, and a second opener 31 formed on a lower end of the overlapped portion 5 of the packaging film 2, is arranged under the first non-bonded portion 10A by being hidden by the first opener 30.

An arrow 16, which can be another indication, showing the direction of tearing is provided by printing for example, on the surface of the first opener 30. Another arrow 17 indicating the direction of tearing is also provided on the surface of the second opener 31.

Free edges 6A and 6B are formed as a result of bonding of the overlapped portion 5 of the packaging film 2 (shown in FIG. 5). Each of the free edges 6A and 6B is folded inside and sealed forming overlapped portions at both sides of the article 1. The overlapped portions are sealed by heat. Thus, the wrapping process is completed.

Functions of the present invention are now explained.

packaging film 2 is torn from the first opener 30 which is formed as the first non-bonded portion 10A in the direction of the arrow 16 (shown in FIG. 4(A)).

Figure 7A:
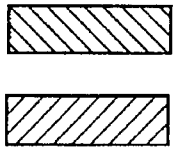
FIGS. 7(A) through 7(C) show heat sealing area of the first embodiment.
Figure 7B:
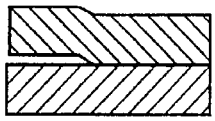
Figure 7C:
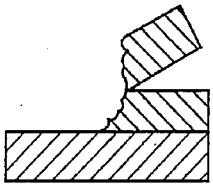

In spite of no nick provided nearby the first opener 30, the packaging film is torn easily at the boundary between bonded and non-bonded portions of packaging film 2. The present invention utilizes that a plastic film is easy to be torn at the boundary of bonding. For instance, the two overlapped portions of the packaging film 2 (shown in FIG. 7(A)) are partially bonded together (shown in FIG. 7(B)). The packaging film 2 tends to be torn at the boundary of the bonded and non-bonded portions of the packaging film 2 (shown in FIG. 7(C)).

Figure 4B:
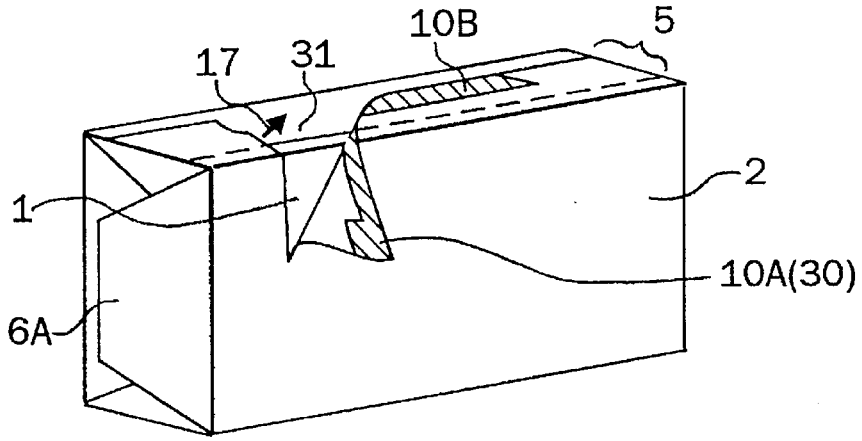
Figure 4C:
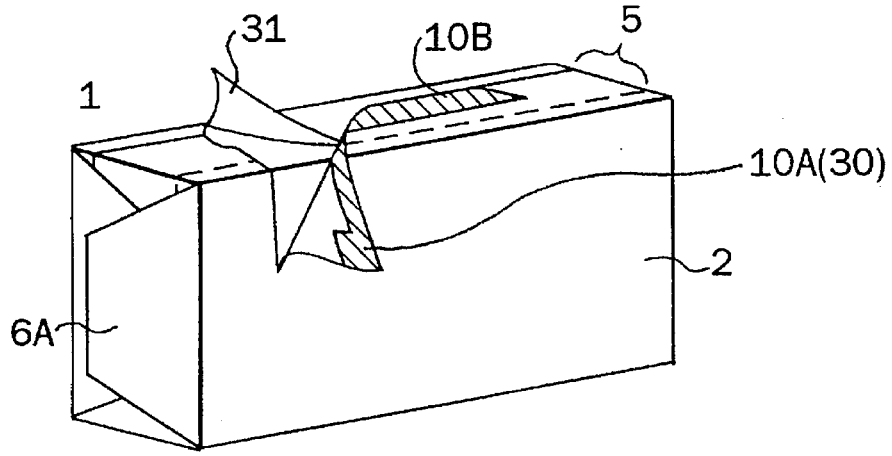

As shown in FIG. 4(B), when the packaging film 2 is torn from the first opener 30, the second opener 31 appears. Then, as shown in FIG. 4(C), the packaging film 2 is torn from the second opener 31 in the direction of another arrow 17. Thus, the packaging film 2 is torn into almost equal divisions, and removed easily and rapidly from the article 1. As no tear tape 3 is required in the present invention, it is possible to avoid problems which are caused by applying the tear tape 3.

Marks of the arrows 16, 17 on the openers 30 and 31 is provided to indicate the direction of tearing of the packaging film 2, so as to allow the packaging film 2 to be removed easily and quickly from the article 1.

[2nd Embodiment]

The second embodiment will be explained with reference to FIGS. 8(A) through 9(D), 14 and 15(A) through 15(B).

Third and fourth non-bonded portions 11A, 11B are formed on respective sides of the first non-bonded portion 10A, 10B, extending to nearby the free edges 6A, 6B. At least a first bonded area 12 is provided nearby the first opener 30 being positioned in the opposite direction to the arrow 16.

Figure 8A:
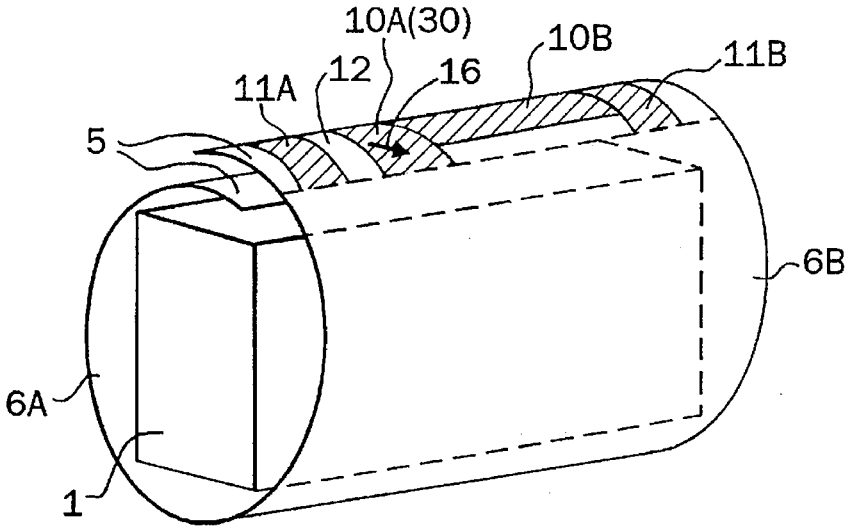
FIGS. 8(A) and 8(B) show perspective views of a second embodiment.

As shown in FIG. 8(A), the first, second, third and fourth non-bonded portions 10A, 10B, 11A, and 11B are formed by aforementioned method for forming a non-bonded portion.

first bonded area 12 is provided nearby the first opener 30, being positioned in the opposite direction to the arrow 16, preventing the overlapped portion 5 from curling up.

Figure 8B:
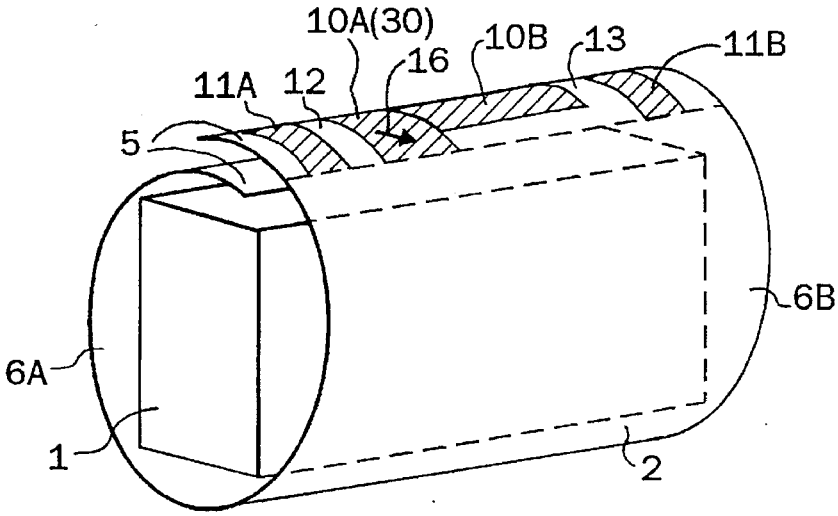

As shown in FIG. 8(B), a third bonded area 13 is formed between the second non-bonded portion 10B and the fourth non-bonded portion 11B.

Figure 14:
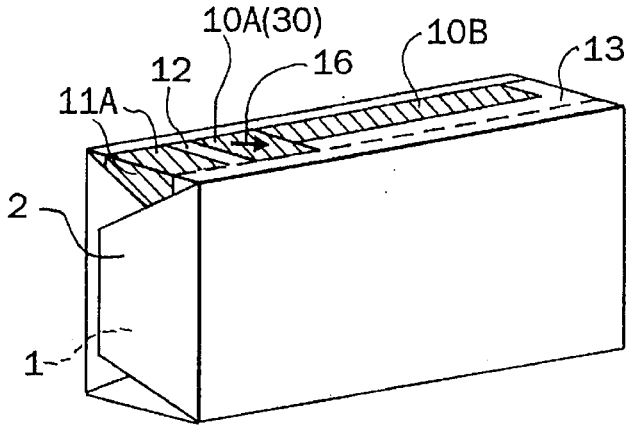
FIG. 14 shows another perspective view of the fourth embodiment.

Another function of the third bonded area 13 is shown in FIG. 14. The third bonded area 13 is formed nearby the corner of the article 1, and prevents the packaging film 2 from curling up.

Figure 15A:
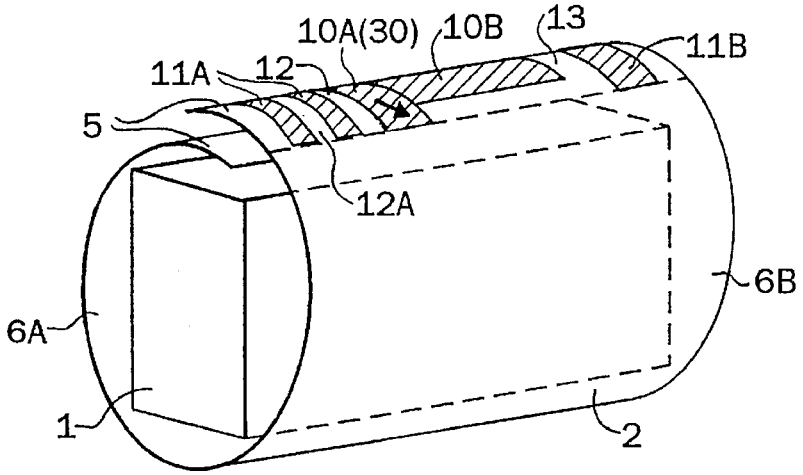
FIGS. 15(A) and 15(B) show further perspective views of the fourth embodiment.
Figure 15B:
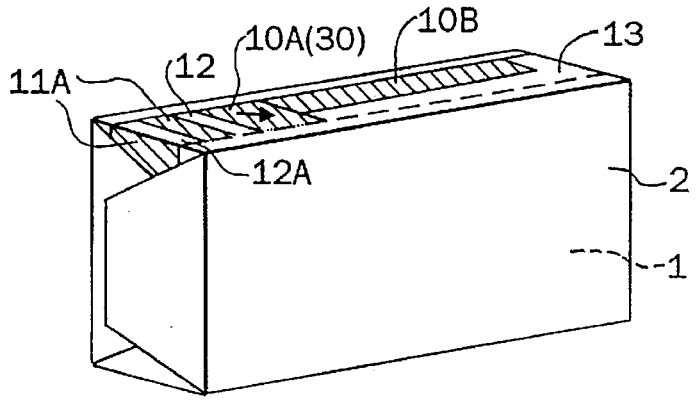

As shown in FIGS. 15(A) and 15(B), a second bonded area 12A is formed on the third non-bonded portion 11A, dividing the third non-bonded portion 11A into two portions, and being positioned nearby the corner of the article 1, this prevents the overlapped portion 5 from curling up.

Figure 9C:
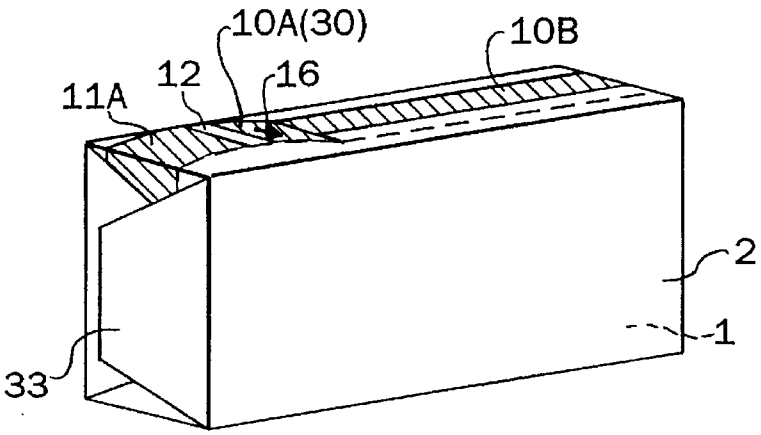
FIGS. 9(A) through 9(D) show other perspective views of the second embodiment.
Figure 9D:
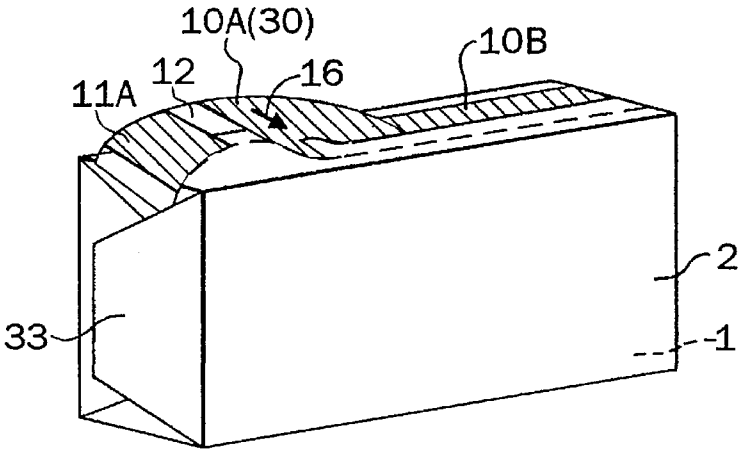
Figure 9A:
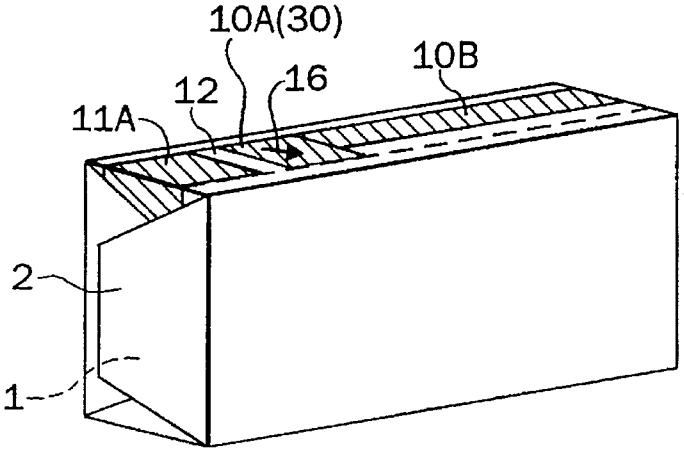

The packaging film 2 is torn easily from the opener 30 because of the provision of the first bonded area 12 by tearing the packaging film 2 in a direction of arrow 16, as shown in FIG. 9(A).

Figure 9B:
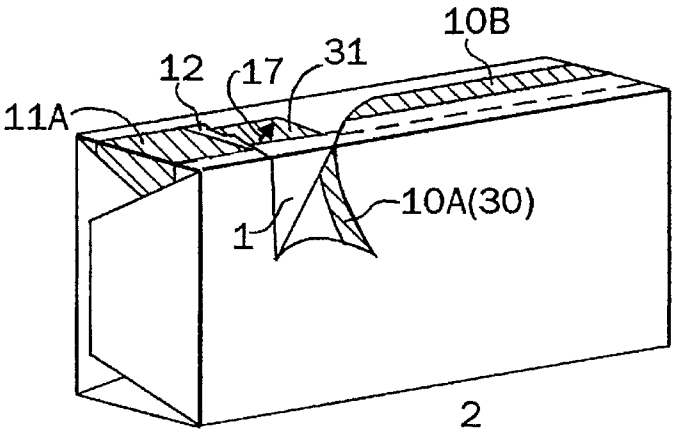

Another feature of the second embodiment is shown in FIGS. 9(A) and 9(B). The packaging film 2 is torn from the first opener 30 by picking it up in a direction of the arrow 16, and then the second opener 31, which is formed on the lower end of the overlapping portion 5 appears. Then, the packaging film 2 is torn from the second opener 31 in a direction of the other arrow 17. Thus, the packaging film 2 is removed from the article 1.

Further feature of the second embodiment is shown in FIGS. 9(C) and 9(D). When the packaging film 2 is not torn in the direction of arrow 16, the third non-bonded portion 11A extended all the overlapped portion 5 and formed nearby the first bonded area 12 slips out of a folded area 33, and the packaging film 2 is removed from the article 1.

[3rd Embodiment]

The third embodiment will be explained with reference to FIGS. 10(A) through 11(B).

Figure 10A:
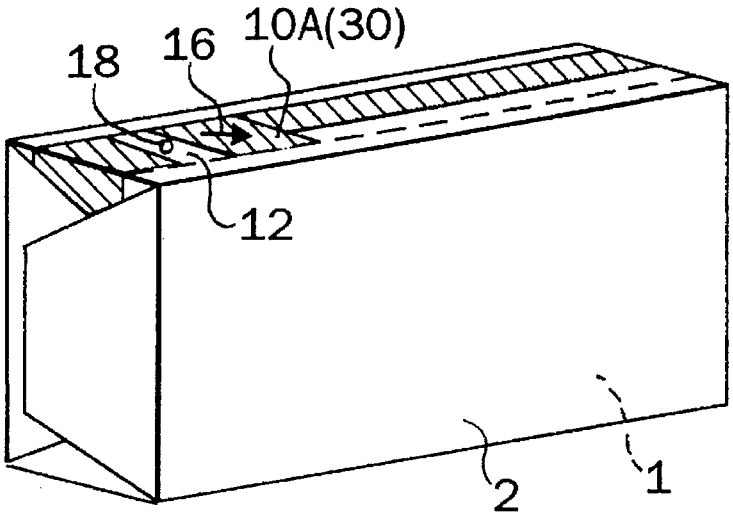
FIGS. 10(A) and 10(B) show perspective views of a third embodiment.
Figure 10B:
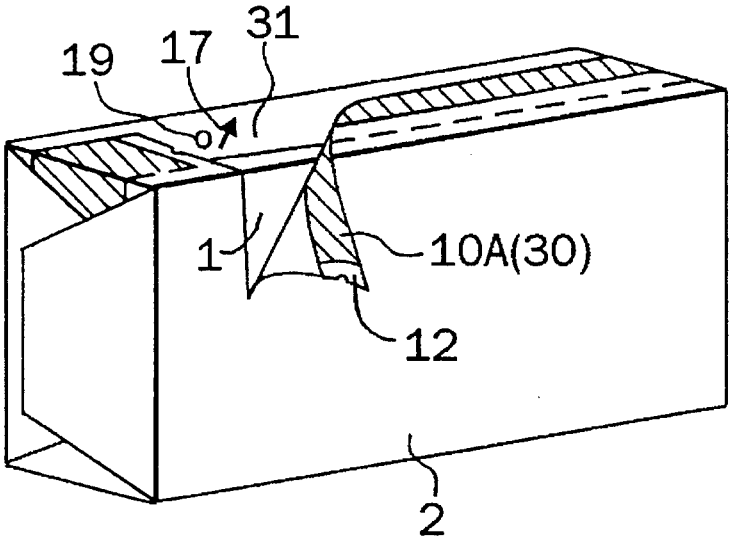

As shown in FIGS. 10(A) and 10(B), a hole 18 is provided on the first bonded area 12 or the first opener 30 to simplify tearing the packaging film 2. A hole 19 is also provided nearby the mark of the other arrow 17 on the second opener 31. Any shape of the holes 18 and 19 will serve the purpose as far as it does not reach to the corners of the article 1. A perforation, for example, will do the same as the hole 19.

Figure 11A:
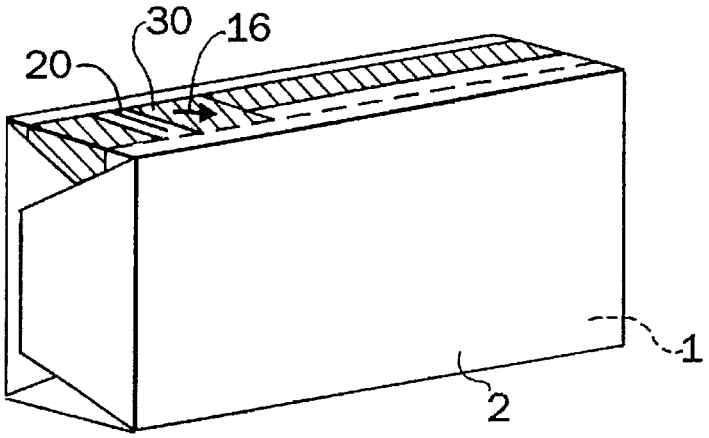
FIGS. 11(A) and 11(B) show other perspective views of the third embodiment.
Figure 11B:
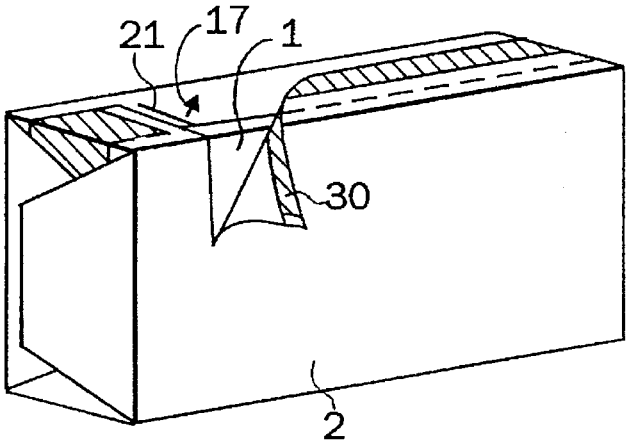
Figure 12A:
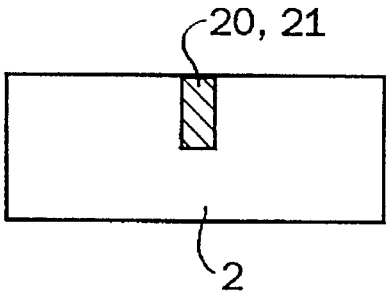
FIGS. 12(A) and 12(B) show sectional views indicating a torn area of a packaging film.
Figure 12B:
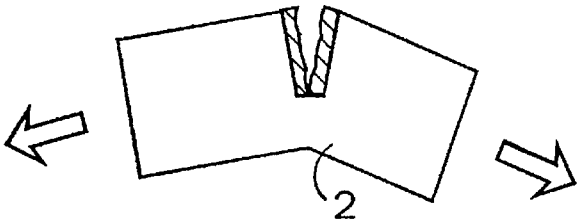

As shown in FIGS. 11(A) and 11(B), welding marks 20, 21 provided at positions of the holes 18 and 19 by heating the packaging film 2, will function like as the above mentioned holes. A heat sealing rod, for example, will produce the welding marks 20, 21 on the edges of the overlapped area 5 respectively. A plastic film is easily torn at such a welding mark. The packaging film 2 having the welding marks 20, 21 is torn easily at the marks, and removed from the article 1 as shown in FIGS. 12(A) and 12(B).

[4th Embodiment]

The fourth embodiment will be explained in FIGS. 13(A) and 13(B).

Figure 13A:
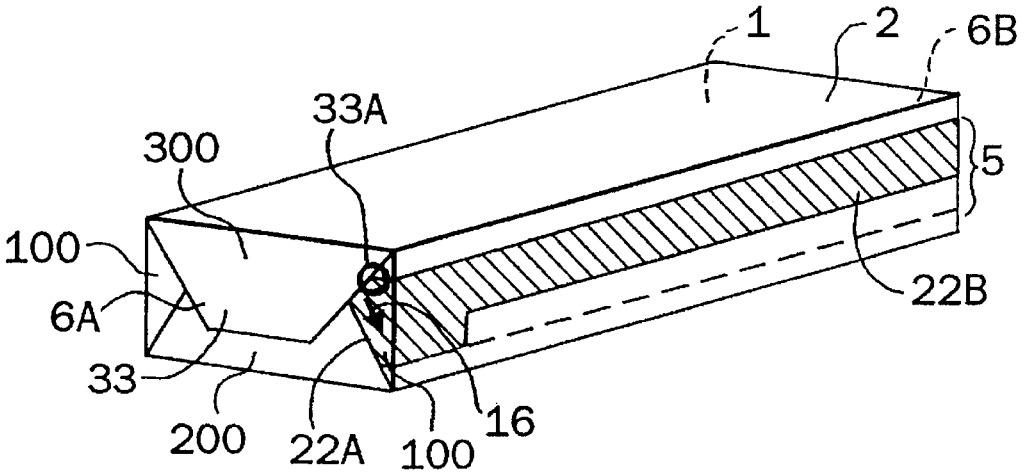
FIGS. 13(A) and 13(B) show perspective views of a fourth embodiment.
Figure 13B:
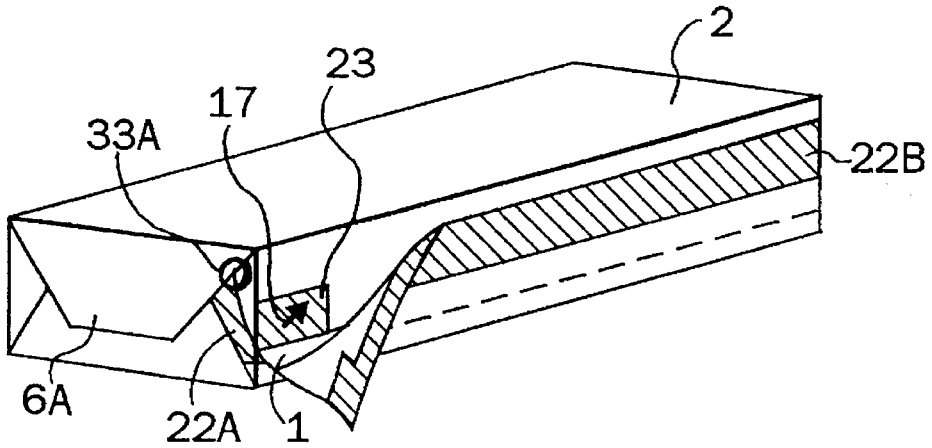

As shown in FIGS. 13(A) and 13(B), a first non-bonded portion 22A is provided on the free edge 6A, and folded as the folded area 33.

A second non-bonded portion 22B is provided over entire length of the overlapped portion 5, which is laid along the edge of the packaging film 2. The width of the first non-bonded portion 22A is smaller than that of the overlapped portion 5, and is larger than one third of that of the overlapped portion 5. The remainder of the overlapped portion 5 is bonded by heat. The free edge 6A is folded inside in the order of 100, 200 and 300, as shown in FIG. 13(A). Another free edge 6B is also folded inside in the same manner. These two ends are sealed by heat. Thus, a process of wrapping is completed.

To remove the packaging film 2 from the article 1, the packaging film 2 is torn from the first non-bonded portion 22A in the direction of the arrow 16. An edge of the folded area 33A assists in tearing the packaging film 2. After removing the upper side of the overlapped portion 5, a third non-bonded portion 23 appears. The packaging film 2 is torn from the third non-bonded portion 23 in the direction of the arrow 17.

A hole, or a welding mark can also be applied to this embodiment to facilitate removing the packaging film 2.

Although the present invention has been described with respect to the specific embodiments, the present invention is not limited to the above embodiment, but can also be adapted to various modifications of the subject matter of the present invention.

According to the embodiments of the present invention, it is disclosed that the wrapping method of the present invention has many advantages for removing the packaging film as follows.

It is an advantage of the present invention that the overlapping portion has a combination of the bonded and the non-bonded portions, which facilitate removing the packaging film.

It is another advantage of the present invention that two openers facilitate removing the packaging film.

It is still another advantage of the present invention that the packaged article has a good appearance as it has no nicks.

It is further advantage of the present invention that no tear tape is needed as an opener.

What is claimed is:

1. A packaging film for wrapping a cubic article by bonding an overlapped portion of said packaging film by applying heat and by folding and sealing open ends of said packaging film, comprising:

a first non-bonded portion provided as opening means on said overlapped portion by leaving a part of said overlapped portion not bonded, said first non-bonded portion having a width which is not larger than that of said overlapped portion, and a second non-bonded portion provided on said overlapped portion by leaving another part of said overlapped portion not bonded, said second non-bonded portion being connected continuously to said first non-bonded portion and having a narrower width than that of said first non-bonded portion.

2. A packaging film in accordance with claim 1, wherein said cubic article has a face divided in a longitudinal direction thereof into a smaller area and a larger area, and said overlapped portion resides on said face and extends over said smaller and larger areas, and wherein said first non-bonded portion is positioned in said smaller area and said second non-bonded portion is positioned in said larger area.

3. A packaging film in accordance with claim 2, wherein a hole is further provided adjacent to said opening means.

4. A packaging film in accordance with claim 2, wherein a welding mark is further provided adjacent to said opening means, and said welding mark is produced by heating said packaging film.

5. A packaging film for wrapping a cubic article by bonding an overlapped portion of said packaging film by applying heat and by folding and sealing open ends of said packaging film, comprising:

a first non-bonded portion provided as first opening means on said overlapped portion by leaving a part of said overlapped portion not bonded, said first non-bonded portion having a width which is not larger than that of said overlapped portion, said first non-bonded portion being an upper layer of said overlapped portion, a second non-bonded portion provided on said overlapped portion by leaving another part of said overlapped portion not bonded, said second non-bonded portion being connected continuously to said first non-bonded portion and having a narrower width than that of said first non-bonded portion, and second opening means provided on said overlapped portion, said second opening means being a lower layer of said overlapped portion and exposed when said first opening means is lifted.

6. A packaging film in accordance with claim 5, wherein said cubic article has a face divided in a longitudinal direction thereof into a smaller area and a larger area, and said overlapped portion resides on said face and extends over said smaller and larger areas, and wherein said first non-bonded portion is positioned in said smaller area and said second non-bonded portion is positioned in said larger area.

7. A packaging film in accordance with claim 6, wherein a hole is further provided adjacent to at least one of said first and second opening means.

8. A packaging film in accordance with claim 6, wherein a welding mark is further provided adjacent to at least one of said first and second opening means, and said welding mark is produced by heating said packaging film.

9. A packaging film in accordance with claim 6, wherein a hole is further provided adjacent to said first opening means and a welding mark being produced by heating said packaging film, is further provided adjacent to said second opening means.

10. A packaging film in accordance with claim 6, wherein a welding mark being produced by heating said packaging film, is further provided adjacent to said first opening means and a hole is further provided adjacent to said second opening means.

* * * * *